United States Patent [19]

Saeki et al.

[11] Patent Number: 4,820,625

[45] Date of Patent: Apr. 11, 1989

[54] DIRECT POSITIVE SILVER HALIDE PHOTOGRAPHIC MATERIAL

[75] Inventors: Naomi Saeki; Nobuaki Inoue; Toshinao Ukai; Yuji Mihara, all of Kanagawa, Japan

[73] Assignee: Fuji Photo Film Co., Ltd., Kanagawa, Japan

[21] Appl. No.: 98,660

[22] Filed: Sep. 21, 1987

[30] Foreign Application Priority Data

Sep. 19, 1986 [JP] Japan ..... 61-221168
Sep. 19, 1986 [JP] Japan ..... 61-221171

[51] Int. Cl.[4] ..... G03C 1/485

[52] U.S. Cl. ..... 430/596; 430/597; 430/940; 430/411; 430/412

[58] Field of Search ..... 430/597, 940, 598, 411, 430/596, 412

[56] References Cited

U.S. PATENT DOCUMENTS 3,910,795 10/1975 Shiba et al. ..... 430/598
4,495,274 1/1985 Yoshida ..... 430/597

*Primary Examiner*—Won H. Louie
*Attorney, Agent, or Firm*—Sughrue, Mion, Zinn, Macpeak & Seas

[57] ABSTRACT

A direct positive silver halide photographic material comprising a support having thereon at least one silver halide emulsion layer comprising a prefogged direct-positive silver halide emulsion, preferably one having a chloride content of at least 70 mol%, said emulsion layer or a hydrophilic colloid layer adjacent to said emulsion layer containing at least one compound represented by the following general formula (I) and, optionally, a specified organic desensitizer, (I)

wherein $Z_1$ represents a group of nonmetallic atoms necessary to complete a nitrogen-containing hetero ring; T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group, or a benzo-condensed ring, each of which is or is not substituted; q represents 1, 2, or 3; and r represents 0, 1 or 2.

15 Claims, No Drawings

DIRECT POSITIVE SILVER HALIDE PHOTOGRAPHIC MATERIAL

FIELD OF THE INVENTION

The present invention relates to a photographic material containing a prefogged direct-positive silver halide emulsion, and, more particularly, to a direct positive silver halide photographic material having improved photographic characteristics.

BACKGROUND OF THE INVENTION

Direct positive silver halide photographic materials are used for copy of various kinds of photographs. In particular, they have been frequently used in a photomechanical process in order to effect positive-positive or negative-negative printing of original half-tone images in the step called "contact work". In the contact work step, it is necessary for the photographic material to have good handling capabilities under a safelight. Various photographic materials which can be handled under orthochromatic and panchromatic safelights have so far been known. Under safelights of those wavelengths, however, there are disadvantages in that workability is low and production cost is high. Therefore, photographic materials which can be used under a visible safelight (or a safelight which can emit predominantly light of wavelengths longer than 450 nm) have been developed in recent years. (Photographic materials of this kind are called bright room-type photographic materials, hereinafter).

However, so far as direct positive silver halide photographic materials are concerned, ways of modifying them so as to be usable under daylight have not yet been developed. As a result, the graphic arts are still subject to such undesirable phenomena as lowering of maximum density, undesirable change in halftone dot area and so on.

As for the reversal characteristics of a direct positive silver halide emulsion, particularly $D_{min}$ thereof, those of silver chlorobromide are more desirable than those of silver chloride and further, those of silver bromide are preferable to those of silver chlorobromide. Accordingly, as the sensitive region is extended to the longer wavelength side, a large amount of dye must be used, which often causes various problems, for example, deterioration of reversal characteristics including decreases in contrast, increases in $D_{min}$ upon long-range storage, and so on.

Further, it is necessary for the photographic materials of the foregoing kind to be sufficiently fogged in order to attain low sensitivity, and insufficient fogging leads often to the problem of a rise in the minimum density ($D_{min}$) of reversal.

Furthermore, even if low $D_{min}$ is attained immediately after production of the photographic materials, the photographic materials are still subject to undesirable phenomena from the view point of the photomechanical process, e.g., increase in $D_{min}$, under conditions such as long-range storage, high temperature and high humidity, and so on.

Many attempts to improve $D_{min}$ of highly sensitive, direct positive silver halide emulsions have so far been made. However, they cannot be said to attain sufficient improvements, so further improvements are desired.

Therefore, the development of photosensitive materials which can lower $D_{min}$ of reversal in direct positive silver halide emulsions and do not suffer from an increase of $D_{min}$ upon long-range storage thereof, and further a method of making it possible to satisfy two contradictory requirements, one requirement being to lower $D_{min}$, and the other requirement being to give a satisfactory safelight aptitude, are much wanted.

SUMMARY OF THE INVENTION

A first object of the present invention is to provide a direct positive silver halide photographic material which can ensure low minimum density ($D_{min}$).

A second object of the present invention is to provide a direct positive silver halide photographic material which has low $D_{min}$ even after long-range storage, particularly under high temperature and high humidity conditions, stable sensitivity, and no drop in $D_{max}$.

A third object of the present invention is to provide a direct positive silver halide photographic material which can be handled under a yellow lamp or ultraviolet-cutoff day-light.

The above-described objects of the present invention have been attained by providing a direct positive silver halide photographic material comprising a support having thereon at least one silver halide emulsion layer comprising a prefogged direct-positive silver halide emulsion, the emulsion layer or a hydrophilic colloid layer adjacent to the emulsion layer containing at least one compound represented by the following general formula (I):

(I)

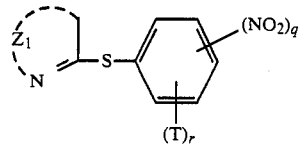

wherein $Z_1$ represents a group of nonmetallic atoms necessary to complete a nitrogen-containing hetero ring; T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group, or a benzo-condensed ring, each of which is or is not substituted; q represents 1, 2 or 3: and r represents 0, 1 or 2, and when r is 2, two T's may be the same or different.

DETAILED DESCRIPTION OF THE INVENTION

Specific examples of nitrogen-containing hetero rings completed by $Z_1$ in the general formula (I) include a 1,2,4-triazole ring, a 1,3,4-oxadiazole ring, a 1,3,4-thiadiazole ring, a tetraazaindene ring, a pentaazaindene ring, a triazaindene ring, a benzothiazole ring, a benzoimidazole ring, a benzoxazole ring, a pyrimidine ring, a triazine ring, a pyridine ring, a quinoline ring, a quinazoline ring, a phthalazine ring, a quinoxaline ring, an imidazo [4,5-b]quinoxaline ring, a tetrazole ring, a 1,3-diazaazulene ring, and so on. These rings each may further have one or more substituents, or may be further fused together with another ring.

The substituents for the nitrogen-containing hetero rings completed by $Z_1$ are the same as defined for T described above.

The groups represented by T may be further substituted with one or more substituents as defined for T described above.

The compound represented by the general formula (I) is preferably added to the silver halide emulsion layer.

Specific examples of the compounds represented by the general formula (I) are illustrated below. However, the present invention should not be construed as being limited to the following examples.

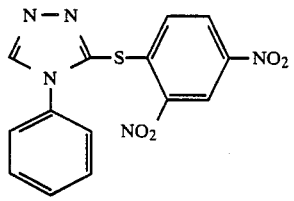

(I-1)

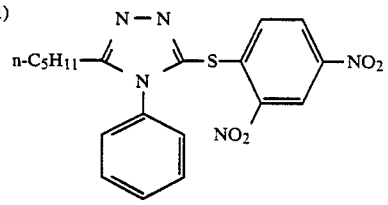

(I-2)

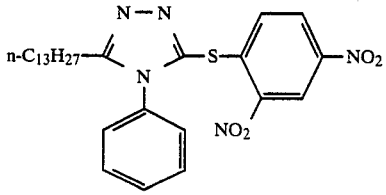

(I-3)

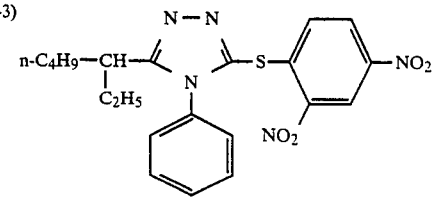

(I-4)

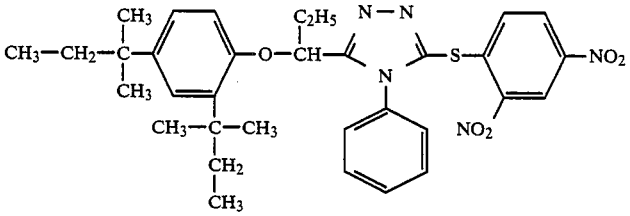

(I-5)

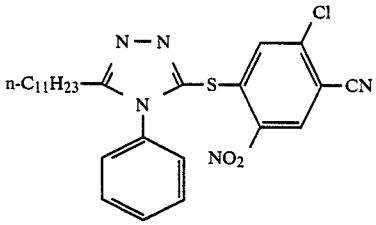

(I-6)

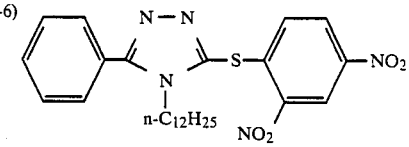

(I-7)

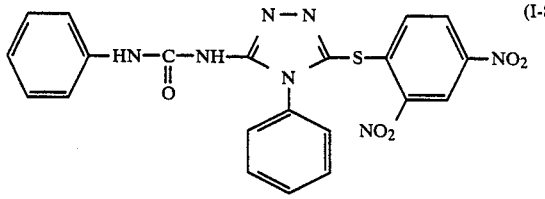

(I-8)

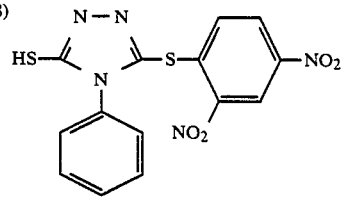

(I-9)

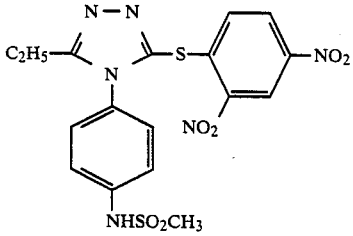

(I-10)

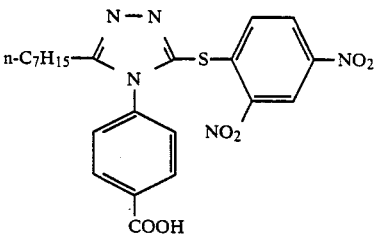

(I-11)

-continued
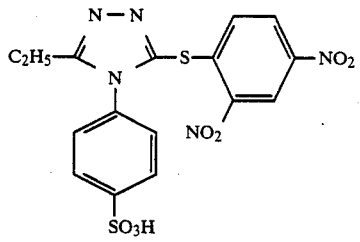
(I-12)
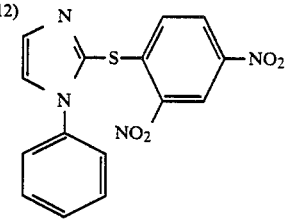
(I-13)
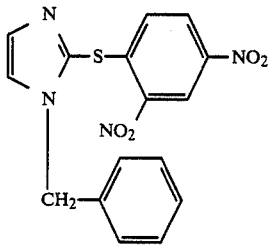
(I-14)
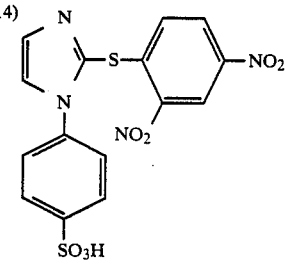
(I-15)
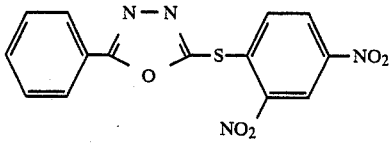
(I-16)
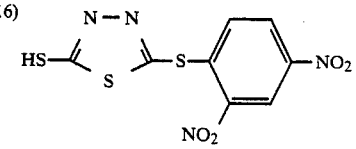
(I-17)
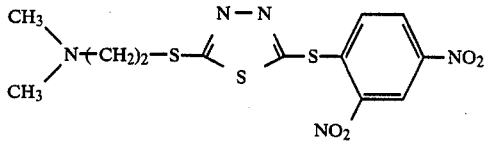
(I-18)
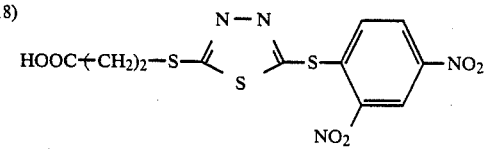
(I-19)
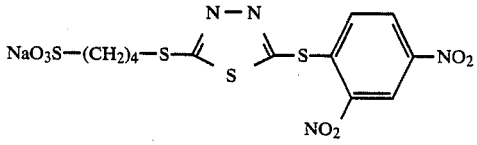
(I-20)
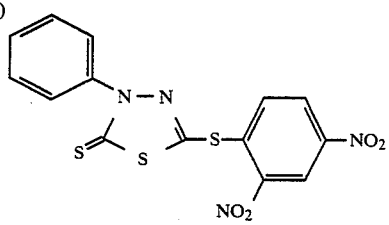
(I-21)
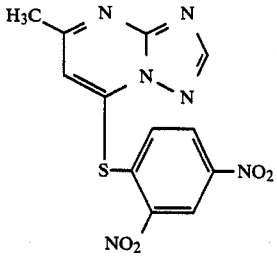
(I-22)
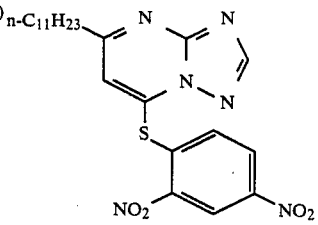
(I-23)
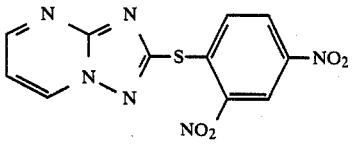
(I-24)
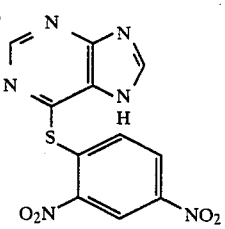
(I-25)

-continued
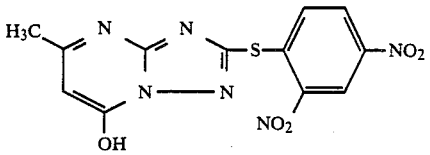
(I-26)
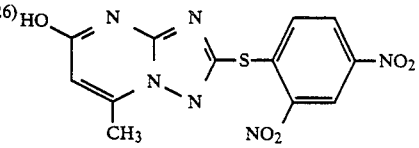
(I-27)
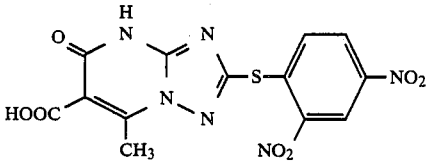
(I-28)
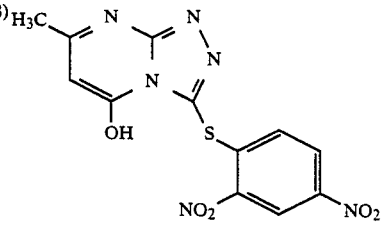
(I-29)
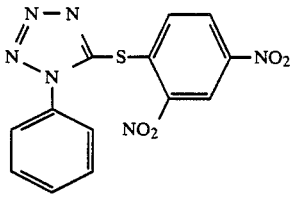
(I-30)
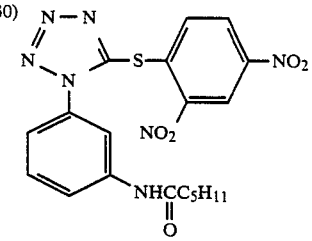
(I-31)
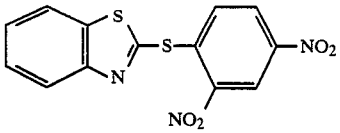
(I-32)
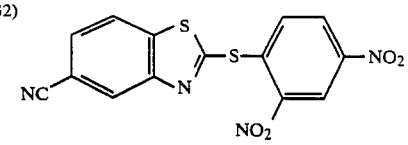
(I-33)
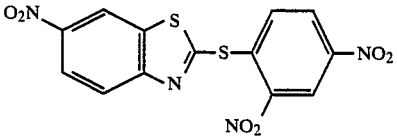
(I-34)
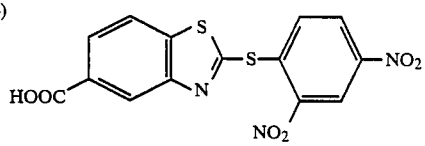
(I-35)
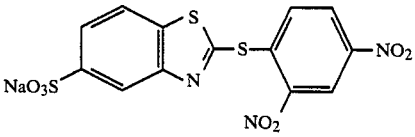
(I-36)
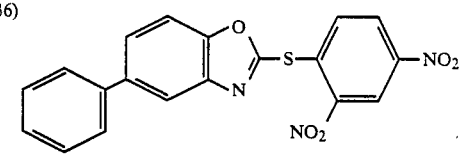
(I-37)
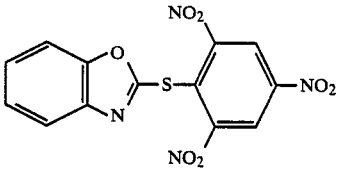
(I-38)
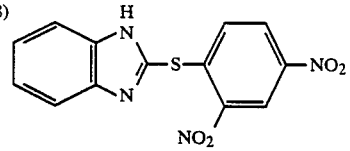
(I-39)
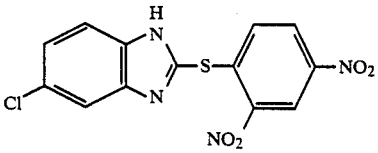
(I-40)
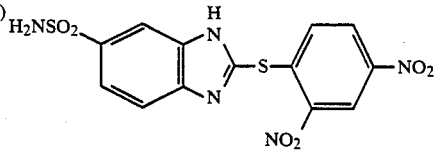
(I-41)
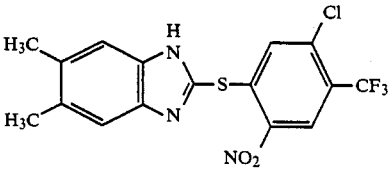
(I-42)
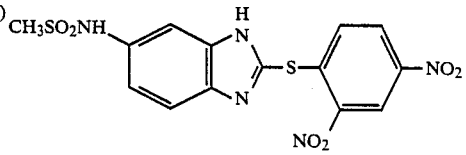
(I-43)

-continued
(I-44)
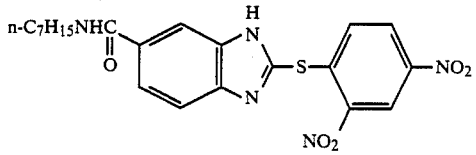
(I-45)
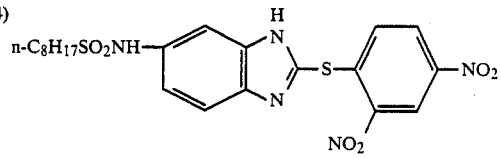
(I-46)
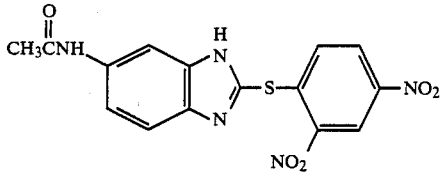
(I-47)
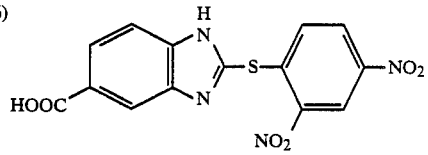
(I-48)
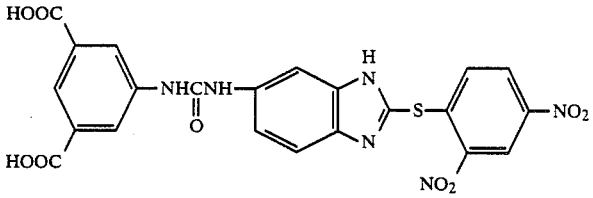
(I-49)
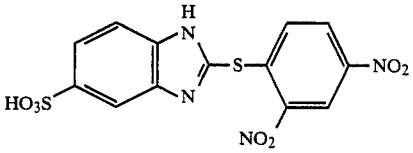
(I-50)
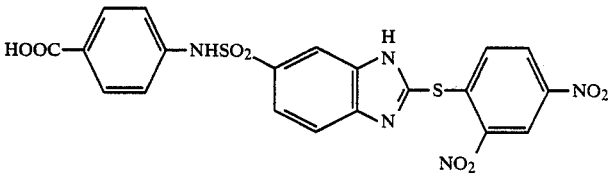
(I-51)
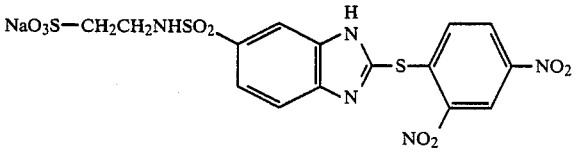
(I-52)
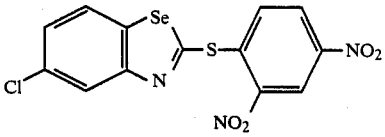
(I-53)
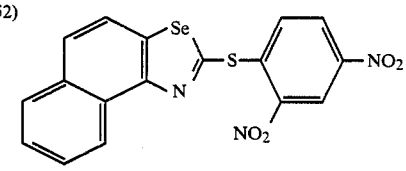
(I-54)
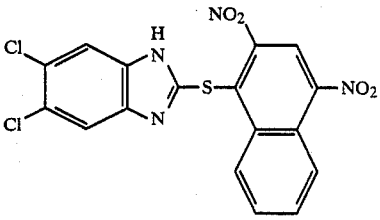
(I-55)
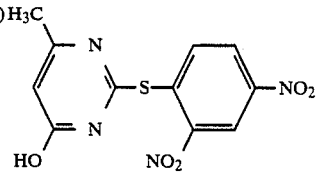
(I-56)
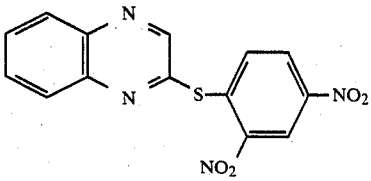
(I-57)
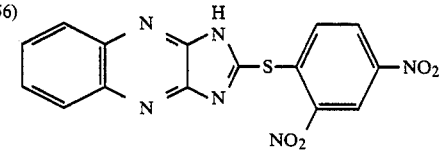

-continued (I-58)

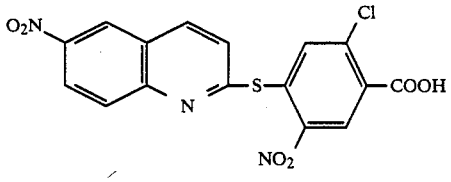

(I-59)

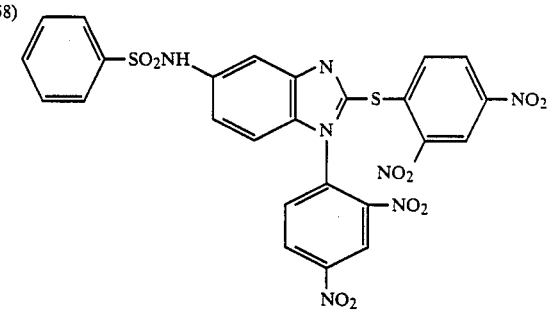

(I-60)

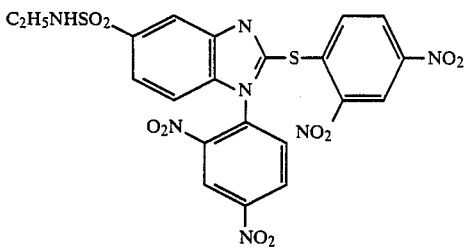

(I-61)

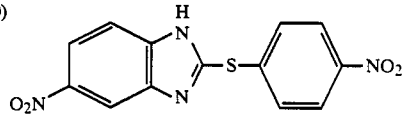

(I-62)

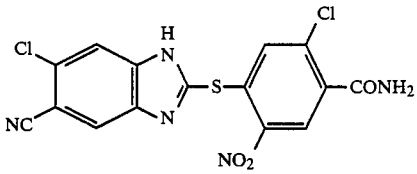

(I-63)

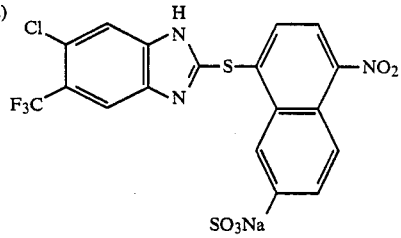

(I-64)

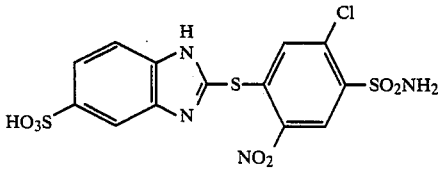

(I-65)

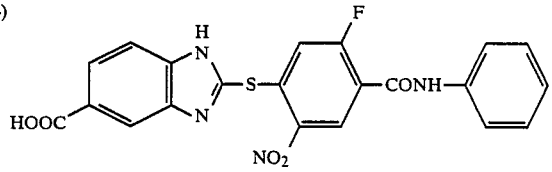

Synthesis examples of the compounds represented by the general formula (I) are disclosed in Japanese Patent Application (OPI) No. 84639/74 (the term "OPI" as used herein means an "published unexamined Japanese patent application").

The compound represented by the general formula (I) is preferably incorporated in an amount of $1\times10^{-6}$ to $5\times10^{-1}$ mol, particularly preferably $1\times10^{-5}$ to $2\times10^{-2}$ mol, pre mol of total silver halide.

Incorporation of the compound of the general formula (I) into a photographic material may be accomplished by addition, to a silver halide emulsion or a hydrophilic colloidal solution for a layer adjacent to a silver halide emulsion layer, in the form of an aqueous solution, when the compound is soluble in water, or in the form of a solution prepared by dissolving the compound in an organic solvent miscible in water, such as an alcohol (e.g. methanol or ethanol), an ester (e.g., ethyl acetate), a ketone (e.g., acetone), etc., when the compound is insoluble in water.

The compound can be added to a silver halide emulsion at any stage of the emulsion-making, from the beginning of chemical ripening to before coating is started. However, the compound is preferably added to the emulsion after the completion of chemical ripening, and particularly preferably added to the coating composition prepared for coating use.

Silver halide emulsions to be used in the present invention may be produced using any method such as an acidic method, a neutral method or an ammonia method. Usable silver halides include silver bromide, silver chloride, silver chlorobromide, silver iodobromide, silver chlorobromoiodide, and so on. When importance is attached to handling under a bright safelight, silver chlorobromide having a high chloride content is preferred, while silver bromide or silver iodobromide is preferred when importance is attached to high sensitivity. In the present invention, any silver halides containing chloride in an amount of at least 70 mol %, e.g., silver chloride, silver chlorobromide, silver chlorobromoiodide, etc., are preferably employed. Especially, silver chlorobromide having a chloride content of 90 mol % or more is preferred over others.

The silver halide grains to be employed in the present invention preferably have a means grain diameter of from 0.01 to 2 μm, more preferably from 0.02 to 1 μm, and particularly preferably from 0.1 to 0.4 μm. The size frequency distribution of the silver halide grains may be narrow or broad, but preferably is narrow. In particular, a so-called monodispersed emulsion wherein 90%, preferably 95%, of the total grains have their individual sizes within the range of ±40%, preferably within ±20%, of the mean grain size can produce a desirable result. The silver halide grains may have a single crystal habit, or various kinds of crystal habits in a mixed condition, but those having a single crystal habit are preferred. The interior and the surface of the silver halide grains may differ, or the silver halide grains may be uniform throughout.

Emulsions which can be used for the direct positive silver halide photographic material of the present invention are divided into two groups.

Emulsions belonging to the first group comprise silver halide grains of the kind which contain nuclei capable of trapping free electrons inside the grains and have a prefogged surface. The characteristic of emulsions of this kind is that they themselves produce positive images directly, and can acquire not only an increase in photographic speed through the spectral sensitization effect but also sensitization in the wavelength region of their intrinsic absorption by the addition of sensitizing dyes. As for the free electron trapping nuclei contained in silver halide grains of this kind, salts of Group VIII metals of the periodic table such as iridium and rhodium are preferably used as an inorganic desensitizer. Furthermore, an organic desensitizer may be used together with the inorganic desensitizer.

Emulsions belonging to the second group do not furnish any nuclei capable of trapping free electrons to the individual interiors of the silver halide grains, and the silver halide grains contained therein have a chemically fogged surface. Emulsions of this kind provide no direct-positive image in themselves, but can provide a direct-positive image by the use of an organic desensitizer.

Specific examples of emulsions which can be used as those having electron-trapping nuclei are described, e.g., in Japanese Patent Publication Nos. 4125/68 and 2940/68, U.S. Pat. Nos. 2,401,051, 2,976,149 and 3,023,102, British Patent Nos. 707,740 and 1,097,999, French Patent Nos. 1,520,824 and 1,520,817, and Belgian Patent No. 713,272, 721,567 and 681,768.

Specific examples of emulsions which can be used as those having no electron-trapping nuclei are described, e.g., in British Patent Nos. 1,186,717, 1,186,714 and 1,186,716, U.S. Pat. Nos. 3,501,306, 3,501,307, 3,501,310, 3,531,288 and 1,520,817, and so on.

In order to make silver halide grains that contain an inner electron acceptor inside the silver halide grains for use in the present invention when employing emulsions belonging to the first group, a water-soluble noble metal compound, e.g., iridium chloride, rhodium chloride or chlorides of other Group VIII metals, has only to be added in the form of a water solution in an amount of $10^{-7}$ to $10^{-3}$ mol, preferably $10^{-5}$ to $10^{-3}$ mole, per mol of silver halide during the preparation of the silver halide grains. As the water-soluble noble metal compounds, rhodium chloride is preferably used in the present invention.

Specific examples of organic desensitizers other than those of the present invention, which can be added effectively in the present invention when using emulsions belonging to the first or second group include dimethinecyanine dyes containing a 2-(nitro-substituted phenyl)indole nucleus, bis-(1-alkyl-2-phenyl)-indole-3-trimethinecyanine dyes, cyanine dyes containing an aryl-substituted indole nucleus, imidazoquinoxaline dyes, asymmetric cyanine dyes containing a carboazole nucleus, trimethinecyanine dyes containing an indole nucleus substituted with an aryl group at the 2-position, cyanine dyes containing a 2,3,3-trialkyl-3H-nitroindole nucleus, cyanine dyes containing a complex fused pyrimidinedione nucleus, quaternarized merocyanine dyes containing a 2-isooxazoline-5-one nucleus, a 2-pyrazoline-5-one nucleus or a complex fused pyrimidinedione nucleus, cyanine dyes containing a 2-arylimino (or alkylimino)-4-areyl (or alkyl)-3-thiazoline nucleus, quaternary ammonium salts of mercocyanine dyes containing 3-aryl-amino or 3-lower fatty acid amido substituted 2-pyrazoline-5-one, pyrylium, thiopyrylium and selenapyrylium salt dyes, cyanine dyes containing a nitro-substituted 2-arylindole nucleus, piperidinium salt dyes, cyanine dyes containing a pyrrole nucleus which is attached thereto via the carbon atom at the 2-position, 1,2-di-aryltrimethineindole dyes, cyanine dyes containing a 4-pyrazole nucleus, polymethine dyes containing an imidazole nucleus, dimethinecyanine dyes containing a 2-phenyl substituted indole nucleus, trimethinecyanine dyes comprising two indole nuclei, cyanine dyes containing a 1-cyanoalkyl-2-arylindole nucleus, cyanine and merocyanine dyes which have a desensitizing substituent group like a nitro group on their two respective nuclei, cyanine dyes containing a 1-alkyl-2-phenyl substituted indole nucleus, cyanine dyes containing a 1-alkoxy-2-arylindole nucleus, cyanine dyes containing an imidazo[4,5,6]quinoxaline nucleus, dyes containing a cycloheptanetriene ring, dimethinecyanine dyes containing an indole nucleus, cyanine dyes containing a pyrazolo[1,5-albenzimidazole nucleus, cyanine dyes containing a pyrazolo[5,1-b]quinazolone nucleus, dimethinecyanine dyes containing a pyrrolo[2,3-b]pyridine nucleus, cyanine dyes containing a pyrrole nucleus, dyes containing a pyrrolo[2,1-b]thiazole nucleus, cyanine dyes containing an indole or indolenine nucleus having a benzoyl or phenylsulfonyl substituent, dyes described in U.S. Pat. No. 2,669,515 including nitrostyryl type compounds, pinakryptol yellow, 5-metanitrobenzylidene rhodanine and so on, bis-pyridinium compounds described in Japanese Patent Publication No. 13059/68, pheazine compounds described in Japanese Patent Publication No. 8746/72, and so on.

Organic desensitizers which can be preferably used in combination with the compound of the general formula (I) in the direct positive silver halide photographic material of the present invention are those represented by the following general formulae (II) and (III), respectively:

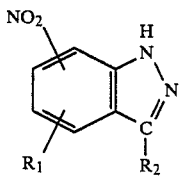

(II)

wherein $R_1$ represents a hydrogen atom, an alkyl group, a halogen atom, —$SO_3M$, or —COOM (with M representing a hydrogen atom, an alkali metal ion or an ammonium ion); and $R_2$ represents a hydrogen atom or a lower alkyl group having 1 to 6 carbon atoms:

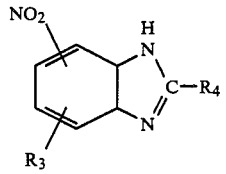

(III)

wherein $R_3$ represents a hydrogen atom, an alkyl group, a halogen atom, —$SO_3M$, or —COOM (with M representing a hydrogen atom, an alkali metal ion or an ammonium ion); and $R_4$ represents a hydrogen atom or an alkyl group having 1 to 12 carbon atoms.

Specific examples of the compounds represented by the general formulae (II) and (III) are illustrated below. However, the invention should not be construed as being limited to the following examples.

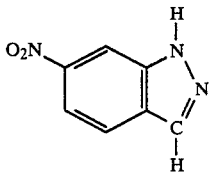

(II-1)

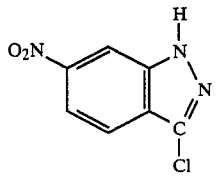

(II-5)

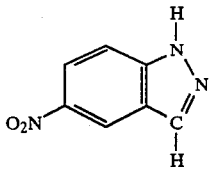

(II-2)

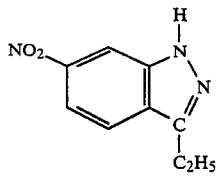

(II-6)

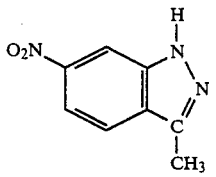

(II-3)

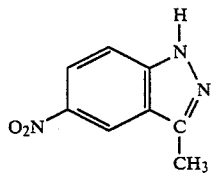

(II-7)

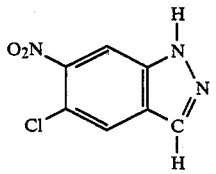

(II-4)

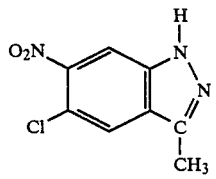

(II-8)

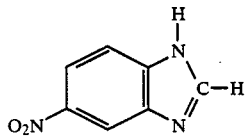

(III-1)

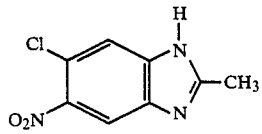

(III-5)

-continued

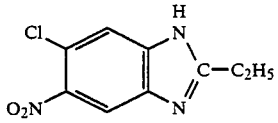

(III-2)

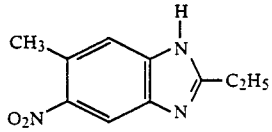

(III-6)

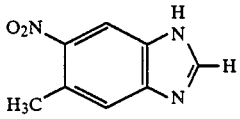

(III-3)

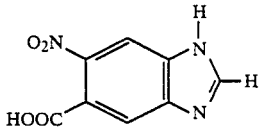

(III-7)

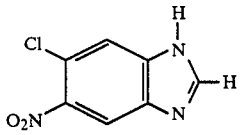

(III-4)

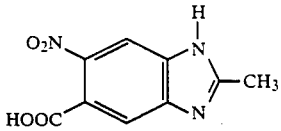

(III-8)

It is preferred that the direct positive silver halide photographic material of the present invention containes at least one compound represented by the general formula (I) and at least one compound represented by the general formulae (II) or (III) in the silver halide emulsion layer or a hydrophilic colloid layer adjacent thereto.

The compound represented by the general formulae (II) or (III) is preferably added in an amount of $1\times10^{-6}$ to $5\times10^{-1}$ mol, particularly $1\times10^{-5}$ to $2\times10^{-2}$ mol, per mol of total silver halide.

The compound represented by the general formulae (II) or (III) may be contained in the same or different layer with the compound represented by the general formula (I).

The compound represented by the general formulae (II) or (III) is preferably added to the silver halide emulsion layer.

Incorporation of the compound of the general formulae (II) or (III) into the photographic light-sensitive material may be accomplished by addition, to a silver halide emulsion or a hydrophilic colloidal solution for a layer adjacent to a silver halide emulsion layer, in the form of an aqueous solution, when the compound is soluble in water, or in the form of a solution prepared by dissolving the compound in an organic solvent miscible in water, such as an alcohol (e.g., methanol or ethanol), an ester (e.g., ethyl acetate), a ketone (e.g., acetone), etc., when the compound is insoluble in water.

The compound can be added to a silver halide emulsion at any stage of the emulsion-making, from the beginning of chemical ripening to before coating is started. However, the compound is preferably added to the emulsion after the completion of chemical ripening, and particularly preferably added to the coating composition prepared for coating use.

Fogging of the direct-positive silver halide to be used in the present invention can be effected using known methods after removal of water-soluble salts produced with the formation of precipitates of the above-described silver halides. The fogging may be carried out using a fogging agent (reducing agent) alone, or a combination of a fogging agent, a useful metal compound which is electrically more positive than silver, such as gold, platinum, rhodium and iridium salts.

Typical examples of fogging agents useful for making the above-described emulsion include formaldehyde, hydrazine, a polyamine (e.g., triethylenetetramine, tetraethylenepentamine, etc.) thiourea dioxide, tetra(hydroxymethyl)phosphonium chloride, an azineborane borohydride compound, stannous chloride, stannic chloride, and so on. Such a fogging agent is used in an amount ranging from $1.0\times10^{-6}$ to $1.0\times10^{-1}$ mol per mol of silver halide.

Typical examples of useful metal compounds which are electrically more positive than silver include soluble salts of gold, rhodium, platinum, palladium, iridium and the like, more specifically potassium chloroaurate, chloroauric acid, ammonium chloropalladate, sodium chloroiridate and so on.

Such an useful metal compound is used in an amount ranging from 0.05 to 200 mg, preferably 0.1 to 100 mg, more preferably 0.4 to 50 mg, per mol of silver halide.

Typical examples of gold compounds which can be used include chloroauric acid, sodium chloroaurate, gold sulfide, gold selenide and so on, and it is effective to let such a gold compound be present in an amount ranging from $1.0\times10^{-6}$ to $1.0\times10^{-4}$ mol per mol of silver halide.

The fogging degree of the prefogged direct-positive silver halide emulsion to be employed in the present invention can be subject to a wide range of change. The fogging degree, as is well-known to one skilled in the art, depends not only on the halide composition, the grain size and other attributes of the silver halide emulsion used, but also on the kind and concentration of the fogging agent used, the pH and pAg values of the emulsion at the time of receiving the fogging treatment, the fogging temperature, the fogging time and so on.

The direct positive silver halide photographic material of the present invention using emulsions belonging to the first group can acquire a high photographic speed by adding a selenium compound as described in Japanese Patent Application (OPI) No. 4282/71, and at lest one sensitizing dye selected from a group comprising dimethinetrimethine cyanine dyes, halogen-substituted hydroxyphthalein dyes, phenazine dyes, cyanine dyes containing both benzothiazole, and benzoselenazole nuclei, cyanine dyes containing a naphthoxazole nucleus, triphenylmethane dyes, cyanine dyes containing an indolenine nucleus, cyanine dyes containing a 2-pyridyl-rhodanine nucleus, cyanine dyes containing a thiazole nucleus, asymmetric cyanines, quinoline, meso-substituted cyanine dyes, cyanine dyes containing a rhodanine nucleus, polyemthine dyes containing three nuclei, and so on.

Further, the direct positive silver halide photographic material of the present invention can contain various kinds of commonly used photographic additives. Examples of stabilizers which can be used include a triazole, an azaindene, a quarternary benzothiazolium compound, a mercapto compound, or a water-soluble inorganic salt of, e.g., cadmium, cobalt, nickel, manganese, gold, thallium, zinc and so on. Examples of hardeners which can be used include aldehydes, such as formaldehyde, glyoxal, mucochloric acid, etc., s-triazines, epoxy compounds, aziridines, vinylsulfonic acid, and so on. Examples of coating aids which may be used include saponin, sodium polyalkylenesulfonates, lauryl or oleyl monoethers of polyethylene glycol, amylated alkyltaurine, fluorine-containing compounds, and so on. Furthermore, it is possible to incorporate color couplers. Besides these additives, a brightening agent, an ultraviolet absorbent, an antiseptic agent, a matting agent, an antistatic agent and so on can be added, if needed.

Moreover, dyes which can absorb and cut visible light, i.e. so called filter dyes, so that handling under an ultraviolet-cut fluorescent lamp is possible, can be used in the direct positive silver halide photographic material of the present invention.

Dyes which can be used in the present invention are those having their main absorption in the visible wavelength part of the intrinsic sensitivity wavelength range of the silver halide emulsion to be used. Among these dyes, those showing an absorption maxima ($\lambda$max) in the wavelength range of from 350 nm to 600 nm are preferred over others. The dyes have no particular restriction as to their chemical structure. Accordingly, oxonol dyes, hemioxonol dyes, mercocyanine dyes, cyanine dyes, azo dyes, arylidene dyes and so on can be used. From the standpoint of getting rid of color strains left after photographic processing, water soluble dyes are useful.

Specific examples of dyes which can be used in the present invention include pyrazolone dyes described in Japanese Patent Publication No. 12576/83, pyrazolone oxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284 and 3,718,472, enaminohemioxonol dyes described in U.S. Pat. No. 3,976,661, arylidene dyes described in U.S. Pat. No. 3,976,661, arylidene dyes described in Japanese Patent Application (OPI) Nos. 3623/76 and 20822/77 and dyes described in British Patents 584,609 and 1,177,429, Japanese Patent Application (OPI) Nos. 85130/73, 99620/74 and 114420/74, U.S. Pat. Nos. 2,533,472, 3,148,187, 3,177,078, 3,247,127, 3,540,887, 3,575,704 and 3,653,905.

The photographic emulsion layers or other hydrophilic colloid layers of the photographic material produced in accordance with the present invention, may contain various surface active agents useful for a wide variety of purposes, e.g., as coating aids, prevention of electrification, improvement in sliding property, emulsifying dispersions, prevention of adhesion, and improvements in photographic characteristics (e.g., development acceleration, increase in contrast, sensitization, etc.)

Suitable examples of surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitane esters, polyalkylene glycol alkylamines or amides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugar, and so on; anionic surface active agents containing an acidic group, e.g., a carboxyl group, a sulfo group, a phospho group, a sulfate group, a phosphate group, etc., such as salts of alkylcarboxylic acids, salts of alkylsulfonic acids, alkylbenzenesulfonates, alkylnaphthalenesulfonates, alkylsufuric acid esters, alkylphosphonic acid esters, N-acyl-N-alkyltaurines, sulfosuccinic acid esters, sulfoalkylpolyoxyethylene alkyl phenyl ethers, polyoxyethylenealkylphosphonic acid esters, and so on; amphoteric surface active agents, such as amino acids, aminoalkylsulfonic acids, aminoalkylsufates, or aminoalkylphosphates, alkylbetaines, amine oxides, etc.; cationic surface active agents such as alkylamine salts, aliphatic or aromatic quarternary ammonium salts, heterocyclic quaternary ammonium salts, e.g., pyridinium salts, imidazolium salts, etc., aliphatic or heterocyclic phosphonium and sulfonium salts; and so on.

Surface active agents preferred particularly in the present invention are polyalkylene oxides having a molecular weight of 600 or more, which are described in Japanese Patent Publication No. 9412/83. For antistatic purposes, it is desirable to employ fluorine-containing surface active agents.

Suitable examples of polyalkylene oxide compounds which can be used in the present invention include products obtained by a condensation reaction of polyalkylene oxides containing at least 10 units of alkyleneoxide having 2 to 4 carbon atoms, for example, ethylene oxide, propylene-1,2-oxide, butylene-1,2-oxide, etc., especially ethylene oxide, with compounds having at least one active hydrogen atom, for example, water, aliphatic alcohols, aromatic alcohols, fatty acids, organic amines, hexitol derivatives, etc.; and block copolymers of two or more kinds of polyalkylene oxides. More specifically, polyalkylene glycols, polyalkylene glycol alkyl ethers, polyalkylene glycol aryl ethers, polyalkylene glycol (alkyl aryl) ethers, polyalkylene glycol esters, polyalkylene glycol fatty acid amides, polyalkylene glycol amines, polyalkylene glycol block copolymers, polyalkylene glycol graft copolymers, and so on can be used as such polyalkylene oxide compounds. Molecular weights of these polyalkylene oxide compounds must be at least 600.

Two or more kinds of polyalkylene oxide chains, may be present in one molecule. In this case, each polyalkylene oxide chain may be composed of less than 10 alkylene oxide units, but the total alkylene oxide units in a molecule should be at least 10. When two or more kinds of polyalkylene oxide chains are present in one molecule, they may be composed of different alkylene oxide units, for example, ethylene oxide and propylene oxide. Polyalkylene oxide compounds which can be used in the present invention are those containing from 14 to 100 alkylene oxide units.

Specific examples of polyalkylene oxide compounds which can be used in the present invention are set forth below.

$HO(CH_2CH_2O)_{90}H$ IV-1

$C_4H_9O(CH_2CH_2O)_{15}H$ IV-2

$C_{12}H_{25}O(CH_2CH_2O)_{15}H$ IV-3

$C_{18}H_{37}O(CH_2CH_2O)_{15}H$ IV-4

$C_{18}H_{37}O(CH_2CH_2O)_{40}H$ IV-5

$C_8H_{17}CH{=}CHC_8H_{16}O(CH_2CH_2O)_{15}H$ IV-6

IV-7

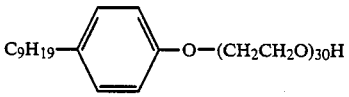

IV-8

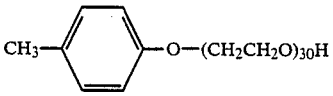

-continued

IV-9

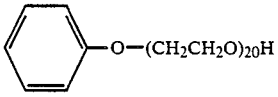

$C_{11}H_{23}COO(CH_2CH_2O)_{80}H$ IV-10

$C_{11}H_{23}COO(CH_2CH_2O)_{24}OCC_{11}H_{23}$ IV-11

IV-12

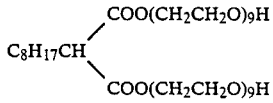

$C_{11}H_{23}CONH(CH_2CH_2O)_{15}H$ IV-13

IV-14

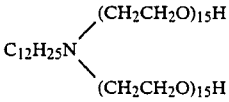

$C_{14}H_{29}N(CH_3)(CH_2CH_2O)_{24}H$ IV-15

IV-16

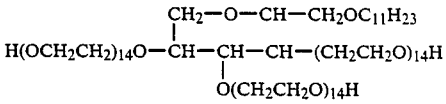

IV-17

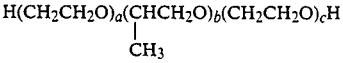

a + b + c = 50 b:a + c = 10:9

IV-18

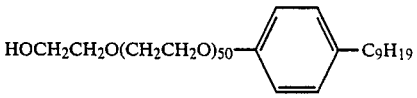

IV-19

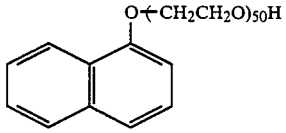

$HO(CH_2CH_2O)_a(CH_2CH_2CH_2CH_2O)_b(CH_2CH_2O)_cH$ IV-20 a + c = 30, b = 14

$HO(CH_2CH_2O)_a(CHCH_2O)_b(CH_2CH_2O)_cH$ IV-21

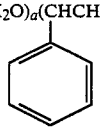

b = 8, a + c = 50

IV-22

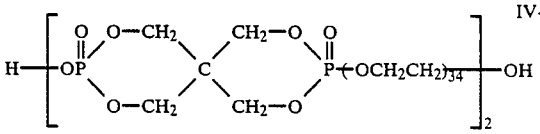

IV-23

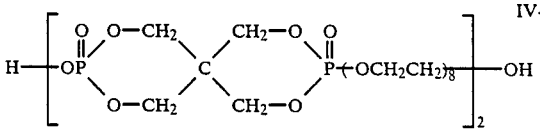

$HO(CH_2CH_2O)_{34}H$ IV-24

The polyalkylene oxide compounds illustrated above are described in Japanese Patent Application (OPI) Nos. 156423/75, 108130/77 and 3217/78. These polyalkylene oxide compounds may be used alone or in mixtures of two or more thereof.

These polyalkylene oxide compounds can be added to silver halide emulsions in the form of an aqueous solution having an appropriate concentration, or a solution prepared by dissolving them into a low boiling point organic solvent compatible with water in a proper concentration, at an appropriate stage of emulsion-making prior to coating, preferably after the chemical ripening thereof. Instead of addition to the emulsion, the polyalkylene oxide compound may be added to a light-insensitive hydrophilic colloid layer, e.g., an interlayer, a protective layer, a filter layer, etc.

The photographic material of the present invention can contain dyes for the purpose of improvement in safelight aptitude. Suitable dyes for such a purpose are described, e.g., in Japanese Patent Application (OPI) Nos. 20822/77, 154439/84 and 208548/84.

Photographic emulsion layers or other hydrophilic colloid layers constituting the photographic material of the present invention can contain a matting agent, such as silica, magnesium oxide, polymethylmethacrylate, etc., for the purpose of prevention of adhesion.

The photographic emulsions of the present invention can contain a dispersion of a water-soluble or sparingly water-soluble synthetic polymer for the purpose of improvement in dimensional stability and so on. For example, polyalkyl(meth)acrylates, polyalkoxyalkyl(meth)acrylates, poly(meth)acrylamides, polyvinyl esters (e.g., vinyl acetate), polyacrylonitrile, and so on can be used alone or in combinations of two or more.

Emulsions to be used in the present invention contain mainly gelatin as a protective colloid. In particular, inert gelatin is used to advantage. Instead of using gelatin, a photographically inert gelatin derivative (e.g., phthaloylated gelatin, etc.), a water-soluble synthetic polymer (e.g., polyvinyl acrylate, polyvinyl alcohol, polyvinyl pyrrolidone, etc.), or the like may be employed.

The novel emulsion of the present invention is coated on an appropriate photographic support, such as glass, a film base, e.g., cellulose acetate, cellulose acetate butyrate, polyesters (e.g., polyethylene terephthalate), and so on.

The developing solution which can be employed in the present invention may be a so-called lithographic developer, which contains sulfite ions in a low concentration, or a developer containing sulfite ions as a preservative in a sufficiently high concentration (particularly above 0.15 mole/liter). Also a developing solution adjusted to pH 9.5 or above, particularly to pH 10.5–12.3, can be employed.

The developing agent which can be used in the method of the present invention has no particular restriction. For example, dihydroxybenzenes (such as hydroquinone), 3-pyrazolidones (such as 1-phenyl-3-pyrazolidone, 4,4-dimethyl-1-phenyl-3-pyrazolidone, etc.), aminophenols (such as N-methyl-p-aminophenol), and so on can be employed alone or in combinations of two or more.

The developing solution which can be employed in the present invention can additionally contain pH buffering agents, such as sulfites, carbonates, borates or phosphates of alkali metals, a development inhibitor or antifoggant, such as a bromide, an iodide or an organic antifoggant (particularly preferably a nitroindazole or a benzotriazole), and so on. Further, a hard water softener, a dissolving aid, a toning agent, a development accelerator, a surface active agent (particularly preferably the above-described polyalkylene oxides), a defoaming agent, a hardener, an agent for preventing silver stain of a photographic film (e.g., 2-mercaptobenzimidazolesulfonic acids) and so on may be present in the developing solution, if desired.

Specific examples of these additives are described in *Research Disclosure,* Vol. 176, RD No. 17643, and so on.

The processing temperature is preferably in the range of from 18° C. to 50° C. However, a temperature lower than 18° C. or higher than 50° C. may be employed.

The fixing solution which can be used is any of those commonly used. Therein, not only thiosulfates and thiocyanates but also organic sulfur compounds known to have a fixing effect can be used as a fixing agent. The fixing solution may additionally contain a water-soluble aluminium salt or the like as a hardener.

The direct positive silver halide photographic material of the present invention can be used for various purposes, for example, as various photographic materials for graphic arts including those for duplication, reproduction, offset master and so on, as special photographic materials including those for X-ray photography, flash photography, electron photography and so on, and as a wide variety of direct positive photographic materials including those for general copying use, micro copying use, direct-positive color photography, quick stabilized photography, diffusion transfer processes, color diffusion transfer processes, combined developing and fixing processing, and so on.

The present invention will now be illustrated in more detail by reference to the following examples. However, the invention should not be construed as being limited to these examples.

Unless otherwise specified, all percents, ratios, etc. are by weight.

EXAMPLE 1

Emulsions (A), (B), (C) and (D) were prepared in the following manner.

Preparation of Emulsion (A)

To a gelatin aqueous solution kept at 50° C. were added an aqueous solution of silver nitrate and an aqueous solution of a sodium chloride/potassium bromide mixture simultaneously at a constant rate over a 30-minute period in the presence of $2\times10^{-5}$ mol/mol silver of rhodium chloride, whereby a silver chlorobromide monodispersed emulsion having a mean grain size of 0.2 μm was obtained (chloride content: 95 mol %).

The emulsion was subjected to a desalting treatment utilizing flocculation, and then thiourea dioxide and chloroauric acid were added thereto in amounts of 1 mg and 0.6 mg, respectively, per mol of silver. The resulting emulsion was ripened at 65° C. until it acquired the maximum ability (i.e., the ratio of sensitivity to fog is the largest). Thus, the emulsion was fogged.

Preparation of Emulsion (B)

A silver chlorobromide monodispersed emulsion having a mean grain size of 0.1 μm and a chloride content of 90 mol % was prepared, and fogged in the same manner as Emulsion (A).

Preparation of Emulsion (C)

An aqueous solution of silver nitrate and an aqueous solution of a sodium chloride/potassium bromide mixture were added simultaneously to a gelatin aqueous solution kept at 55° C. over a 40-minute period in the presence of $2\times10^{-5}$ mol/mol silver of rhodium chloride while the potential of the reaction system was being kept at +55 mV, whereby a cubic silver chlorobromide monodispersed emulsion having a mean grain size of 0.2 μm and a chloride content of 50 mol % was obtained. The thus prepared emulsion was fogged in the same manner as Emulsion (A).

Preparation of Emulsion (D)

A silver nitrate aqueous solution and a sodium bromide aqueous solution was added simultaneously at a constant rate to a gelatin aqueous solution kept at 70° C. over a 80-minute period in the presence of $3\times10^{-5}$ mol/mol silver of rhodium chloride while the potential of the reaction system was being kept at +55 mV, whereby a cubic silver bromide monodispersed emulsion having a mean grain size of 0.2 μm was obtained.

The emulsion was subjected to a desalting treatment utilizing flocculation, and then thiourea dioxide and chloroauric acid were added thereto in amounts of 10 mg and 8 mg, respectively, per mol of silver. The resulting emulsion was ripened at 65° C. until it acquired the maximum ability. Thus, the emulsion was fogged.

These emulsions each were divided into four fractions, and thereto were added the compounds represented by formula (I) of the present invention as described in Table 1, respectively. Subsequently, $4\times10^{-4}$ mol/mol silver of polyalkylene oxide compound (IV-7), a 10% KBr aqueous solution and 1,3-divinylsulfonyl-2-propanol were added to prepare a coating composition. The coating composition was coated on a polyethylene terephthalate film at a silver coverage of 3.0 g/m$^2$ simultaneously with a protective layer comprising the arylidene dye of the structural formula (1) set forth below (30 mg/m$^2$) and a silica as a matting agent. The thus obtained samples each were wedgewise exposed by means of a Model P 607 printer made by Dainippon Screen Mfg. Co., Ltd., developed with a developer having the composition described below at 38° C. for 20 seconds, and subjected, in sequence, to stop, fixation, washing and drying steps. The results obtained are shown in Table 1.

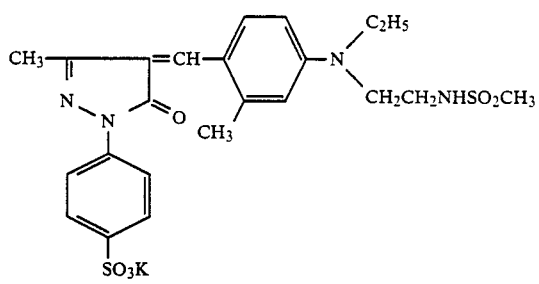

(1)

Evaluation of safelight aptitute was carried out by measuring the time required for decreasing the halftone dot area by 2% under illuminance of 200 lux using a UV-cut fluorescent lamp with respect to a sample that previously received contact exposure under the condition that 50% halftone original might be converted to 50% halftone dot.

The relative sensitivity shown in Table 1 is expressed in terms of a relative value of the reciprocal of the exposure required for providing a density of 1.5 as a result of a 20 second development at 38° C., taking the sensitivity of Sample 1 as 100.

The developing solution used had the following composition.

| | |
|---|---|
| Hydroquinone | 35.0 g |
| N—methyl-p-aminophenol ½ sulfate | 0.8 g |
| Sodium Hydroxide | 9.0 g |
| Potassium tertiary phosphate | 74.0 g |
| Potassium Sulfite | 90.0 g |
| Disodium Ethylenediaminetetraacetate | 1.0 g |
| 3-Diethylamino-1-propanol | 15.0 g |
| 5-Methylbenzotriazole | 0.5 g |
| Sodium Bromide | 3.0 g |
| Water to make | 1 liter |
| pH adjusted to | 11.60 |

TABLE 1

| Sample No. | Emulsion | Compound of Formula (I) Kind | Compound of Formula (I) Amount added (mol/mol Ag) | Photographic Characteristics Sensitivity | Photographic Characteristics $D_{max}$ | Photographic Characteristics $D_{min}$ | Safelight Aptitude | Note |
|---|---|---|---|---|---|---|---|---|
| 1 | A | — | — | 100 | 5.0 | 0.20 | — | Comparison |
| 2 | " | (I-3) | $1\times10^{-3}$ | 107 | 5.0 | 0.11 | 15' | Invention |
| 3 | " | " | $2\times10^{-3}$ | 123 | 4.9 | 0.09 | 12' | Invention |
| 4 | " | (I-40) | " | 110 | 4.7 | 0.12 | 15' | Invention |
| 5 | B | — | — | 100 | 5.0 | 0.19 | — | Comparison |
| 6 | " | (I-3) | $1\times10^{-3}$ | 105 | 5.0 | 0.10 | 15' | Invention |
| 7 | " | " | $2\times10^{-3}$ | 126 | 5.0 | 0.08 | 10' | Invention |
| 8 | " | (I-40) | " | 117 | 4.7 | 0.11 | 15' | Invention |
| 9 | C | — | — | 100 | 5.0 | 0.15 | — | Comparison |
| 10 | " | (I-3) | $1\times10^{-3}$ | 105 | 5.2 | 0.12 | 5' | Invention |
| 11 | " | " | $2\times10^{-3}$ | 120 | 5.0 | 0.11 | 3' | Invention |
| 12 | " | (I-40) | " | 120 | 4.9 | 0.10 | 4' | Invention |
| 13 | D | — | — | 100 | 5.2 | 0.13 | — | Comparison |
| 14 | " | (I-3) | $1\times10^{-3}$ | 105 | 5.2 | 0.11 | 3' | Invention |
| 15 | " | " | $2\times10^{-3}$ | 107 | 5.0 | 0.11 | 2' | Invention |
| 16 | " | (I-40) | " | 112 | 4.8 | 0.10 | 2' | Invention |

As can be seen from the data set forth in Table 1, the samples prepared in accordance with the present invention had low $D_{min}$, compared with the comparative samples, and those having a chloride content of 70 mol % or more among the samples of the present invention, Sample Nos. 2 to 4 and Sample Nos. 6 to 8, were excellent in safelight aptitude, too.

EXAMPLE 2

Emulsions (E), (F) and (G) were prepared in the following manner.

Preparation of Emulsion (E)

An aqueous solution of silver nitrate and an aqueous solution of a sodium chloride/potassium bromide mixture were added simultaneously at a constant rate to a gelatin aqueous solution kept at 50° C. over a 40-minute period in the presence of $2\times10^{-4}$ mol/mol silver of rhodium chloride while the potential of the reaction system was being regulated to +80 mV, whereby a silver chlorobromide monodispersed emulsion having a mean grain size of 0.22 μm and a chloride content of 90 mol % was obtained. The emulsion was subjected to a desalting treatment utilizing flocculation, and then thiourea dioxide was added thereto in an amount of 26 mg per mol of silver. The resulting emulsion was ripened at 65° C. until it acquired the maximum ability. Thus, the emulsion was fogged.

Preparation of Emulsion (F)

An aqueous solution of silver nitrate and an aqueous solution of a sodium chloride/potassium bromide mixture were added simultaneously to a gelatin aqueous solution kept at 55° C. over a 40-minute period in the presence of $2.5\times10^{-4}$ mol/mol silver of rhodium chloride while the potential of the reaction system was being regulated to +80 mV, whereby a cubic silver chlorobromide monodispersed emulsion having a mean grain size of 0.22 μm and a chloride content of 55 mol % was obtained. The thus obtained emulsion was fogged in the same manner as Emulsion (E).

Preparation of Emulsion (G)

A silver nitrate aqueous solution and a sodium bromide aqueous solution were added simultaneously at a constant rate of a gelatin aqueous solution kept at 70° C. over an 80-minute period in the presence of $2.5\times10^{-4}$ mol/mol silver of rhodium chloride while the potential of the reaction system was being regulated to +60 mV, whereby a cubic silver bromide monodispersed emulsion having a mean grain size of 0.22 μm was obtained.

The emulsion was subjected to a desalting treatment utilizing flocculation, and then thiourea dioxide was added thereto in an amount of 30 mg per mol of silver. The resulting emulsion was ripened at 65° C. until it acquired the maximum ability. Thus, the emulsion was fogged.

These emulsions each were divided into six fractions, and thereto were added the additives of the present invention as described in Table 2, respectively. Subsequently, $5\times10^{-4}$ mol/mol silver of polyalkylene oxide compound (IV-7), a 10% KBr aqueous solution, and a sodium salt of 2-hydroxy-4,6-dichloro-1,3,5-triazine and 1,3-divinylsulfonyl-2-propanol as hardeners were added to prepare a coating composition. The coating composition was coated on a polyethylene terephthalate film at a silver coverage of 3.2 g/m² simultaneously with a protective layer comprising the dye of the structural formula (2) shown below (30 mg/m²) and a matting agent constituted with silica mat and an ethylacrylate dispersion. Evaluations of photographic characteristics and safelight aptitude were made in accordance with the same processes, respectively, as in Example 1.

(2)

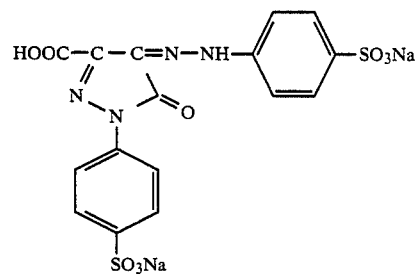

TABLE 2

| Sample No. | Emulsion | Compound of Formula (I) Kind | Compound of Formula (I) Amount added (mol/mol Ag) | Photographic Characteristics Sensitivity | Photographic Characteristics $D_{max}$ | Photographic Characteristics $D_{min}$ | Safelight Aptitude | Note |
|---|---|---|---|---|---|---|---|---|
| 1 | E | — | — | 100 | 5.3 | 0.22 | — | Comparison |
| 2 | " | (I-2) | $1.5\times10^{-3}$ | 107 | " | 0.06 | 20' | Invention |
| 3 | " | " | $3\times10^{-3}$ | 112 | " | 0.06 | 15' | Invention |
| 4 | " | (I-23) | $1.5\times10^{-3}$ | 110 | " | 0.06 | 22' | Invention |
| 5 | " | " | $3\times10^{-3}$ | 123 | 5.2 | 0.06 | 12' | Invention |
| 6 | " | (I-40) | $3\times10^{-3}$ | 112 | 4.9 | 0.07 | 15' | Invention |
| 7 | F | — | — | 100 | 5.4 | 0.18 | — | Comparison |
| 8 | " | (I-2) | $1.5\times10^{-3}$ | 105 | 5.3 | 0.09 | 6' | Invention |
| 9 | " | " | $3\times10^{-3}$ | 115 | 5.3 | 0.08 | 4' | Invention |
| 10 | " | (I-23) | $1.5\times10^{-3}$ | 107 | 5.3 | 0.09 | 6' | Invention |
| 11 | " | " | $3\times10^{-3}$ | 117 | 5.2 | 0.09 | 3' | Invention |
| 12 | " | (I-40) | $3\times10^{-3}$ | 107 | 4.9 | 0.10 | 8' | Invention |
| 13 | G | — | — | 102 | 5.4 | 0.15 | — | Comparison |
| 14 | " | (I-2) | $1.5\times10^{-3}$ | 107 | 5.4 | 0.10 | 5' | Invention |
| 15 | " | " | $3\times10^{-3}$ | 117 | 5.3 | 0.08 | 2' | Invention |
| 16 | " | (I-23) | $1.5\times10^{-3}$ | 107 | 5.4 | 0.10 | 5' | Invention |
| 17 | " | " | $3\times10^{-3}$ | 120 | 5.3 | 0.08 | 2' | Invention |
| 18 | " | (I-40) | $3\times10^{-3}$ | 117 | 4.7 | 0.09 | 2' | Invention |

As can be seen from the data set forth in Table 2, the samples prepared in accordance with the present invention had low $D_{min}$, compared with the comparative samples, and those having a chloride content of 70 mol % or more among the samples of the present invention, Sample Nos. 2 to 6, were excellent in safelight aptitude, too.

EXAMPLE 3

The sample Nos. 1 to 16, which had been prepared in Example 1, were developed with a so-called lithographic developer having the following composition (at 32° C. for 60 sec.). In this example, the same results as in Example 1 were obtained.

| Developer Composition | |
|---|---|
| Sodium Carbonate (monohydrate) | 50 g |
| Formaldehyde/Hydrogen Sulfite Adduct | 45 g |
| Potassium Bromide | 2 g |
| Hydroquinone | 18 g |
| Sodium Sulfite | 2 g |
| 5-Nitroindazole | 3 mg |
| Water to make | 1 liter |

EXAMPLE 4

Sample Nos. 11 to 18 were prepared in the same manner as Sample No. 2 prepared in Example 1 except that the compounds of the present invention, (I-11), (I-13), (I-18), (I-30), (I-33), (I-37) and (I-39), respectively, were used in place of the compound (I-3), and processed in the same manner as in Example 1. Satisfactory results were obtained similar to those obtained in Example 1.

EXAMPLE 5

An aqueous solution of silver nitrate and an aqueous solution of a sodium chloride/potassium bromide mixture were added simultaneously at a constant rate to a gelatin aqueous solution kept at 50° C. over a 30-minute period in the presence of $2\times10^{-5}$ mol/mol silver of rhodium chloride, whereby a silver chlorobromide monodispersed emulsion having a mean grain size of 0.2 μm and a chloride content of 95 mol % was obtained.

The emulsion was subjected to a desalting treatment utilizing flocculation, and then thiourea dioxide and chloroauric acid were added thereto in amounts of 1 mg and 0.6 mg, respectively, per mol of silver. The resulting emulsion was ripened at 65° C. until it acquired the maximum ability. Thus, the emulsion was fogged.

The resulting emulsion was divided into fractions, and thereto were added the additives of the present invention as described in Table 3, respectively. Subsequently, $4\times10^{-4}$ mol/mol silver of polyalkylene oxide compound (IV-7), a 10% KBr aqueous solution and a hardener constituted of a sodium salt of 2-hydroxy-4,6-dichloro-1,3,5-triazine and 1,3-divinylsulfonyl-2-propanol were added to prepare a coating composition. The coating composition was coated on a polyethylene terephthalate film at a silver coverage of 3.0 g/m² simultaneously with a protective layer comprising the benzylidene dye of the structural formula (3) set forth below (30 mg/m²) and a matting agent constituted of silica and a polyethylacrylate dispersion. The thus obtained sample was wedgewise exposed by means of a Model P 607 printer made by Dainippon Screen Mfg. Co., Ltd., developed with a developer having the composition set forth below at 38° C. for 20 seconds, and subjected, in sequence, to stop, fixation, washing and drying steps. The results obtained (photographic characteristics (1)) are shown in Table 3.

(3)

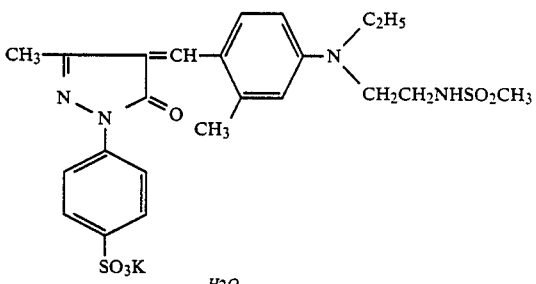

$\lambda_{max}^{H_2O}$ = 503 nm
m.p. = 217~218° C.

The photographic characteristics (2) shown in Table 3 were data obtained using sample films after 3 days of storage under the conditions of 50° C. and 75% RH and following the same bases of evaluation as the photographic characteristics (1).

The relative sensitivity shown in Table 3 is expressed in terms of a relative value of the reciprocal of an exposure required for providing a density of 1.5 as a result of a 20 second development at 38° C., taking the sensitivity of Sample 1 as 100.

The developing solution used had the following composition.

| | |
|---|---|
| Hydroquinone | 35.0 g |
| N—methyl-p-aminophenol ½ sulfate | 0.8 g |
| Sodium Hydroxide | 9.0 g |
| Potassium Tertiary Phosphate | 74.0 g |
| Potassium Sulfite | 90.0 g |
| Disodium Ethylenediaminetetraacetate | 1.0 g |
| 3-Diethylamino-1-propanol | 15.0 g |
| 5-Methylbenzotriazole | 0.5 g |
| Sodium Bromide | 3.0 g |
| Water to make | 1 liter |
| pH adjusted to | 11.60 |

TABLE 3

| Sample No. | Compound of Formula (I) Kind | Compound of Formula (I) Amount added (mol/mol Ag) | Compound of Formula (II), (III) Kind | Compound of Formula (II), (III) Amount added (mol/mol Ag) | Photographic Characteristics (1) Sensitivity | Photographic Characteristics (1) Dmax | Photographic Characteristics (1) Dmin | Photographic Characteristics (2) Sensitivity | Photographic Characteristics (2) Dmax | Photographic Characteristics (2) Dmin | |
|---|---|---|---|---|---|---|---|---|---|---|---|
| 1 | — | — | — | — | 100 | 5.2 | 0.20 | — | — | — | |
| 2 | I-2 | $5\times10^{-4}$ | — | — | 110 | 5.1 | 0.15 | 100 | 5.1 | 0.18 | Invention |
| 3 | " | $1\times10^{-3}$ | — | — | 120 | 5.1 | 0.10 | 102 | 5.1 | 0.15 | Invention |
| 4 | I-3 | $5\times10^{-4}$ | — | — | 115 | 5.1 | 0.14 | 105 | 5.1 | 0.18 | Invention |
| 5 | " | $1\times10^{-3}$ | — | — | 132 | 5.1 | 0.10 | 120 | 5.1 | 0.14 | Invention |
| 6 | I-40 | $1\times10^{-3}$ | — | — | 105 | 4.9 | 0.16 | 95 | 4.8 | 0.18 | Invention |
| 7 | " | $2\times10^{-3}$ | — | — | 112 | 4.8 | 0.14 | 100 | 4.7 | 0.17 | Invention |
| 8 | — | — | II-2 | $1\times10^{-3}$ | 102 | 5.0 | 0.18 | 100 | 4.9 | 0.18 | |
| 9 | — | — | " | $2\times10^{-3}$ | 105 | 5.0 | 0.17 | 100 | 4.9 | 0.18 | |
| 10 | — | — | III-1 | $1\times10^{-3}$ | 100 | 5.2 | 0.19 | 91 | 5.1 | 0.20 | |
| 11 | — | — | " | $2\times10^{-3}$ | 102 | 5.1 | 0.18 | 95 | 5.0 | 0.19 | |
| 12 | I-2 | $5\times10^{-4}$ | II-2 | $1\times10^{-3}$ | 126 | 5.0 | 0.04 | 117 | 5.0 | 0.05 | Invention |
| 13 | " | $1\times10^{-3}$ | " | " | 129 | 5.0 | 0.04 | 123 | 5.0 | 0.04 | Invention |
| 14 | " | " | III-1 | $2\times10^{-3}$ | 123 | 5.0 | 0.04 | 120 | 5.0 | 0.05 | Invention |
| 15 | I-3 | $5\times10^{-4}$ | II-2 | $1\times10^{-3}$ | 135 | 5.0 | 0.04 | 132 | 5.0 | 0.04 | Invention |
| 16 | " | " | " | " | 138 | 5.0 | 0.04 | 135 | 5.0 | 0.04 | Invention |
| 17 | " | $1\times10^{-3}$ | III-1 | $2\times10^{-3}$ | 135 | 5.0 | 0.04 | 132 | 5.0 | 0.04 | Invention |
| 18 | I-40 | $2\times10^{-3}$ | II-2 | $1\times10^{-3}$ | 115 | 4.9 | 0.07 | 105 | 5.0 | 0.08 | Invention |

TABLE 3-continued

| Sample No. | Compound of Formula (I) Kind | Compound of Formula (I) Amount added (mol/mol Ag) | Compound of Formula (II), (III) Kind | Compound of Formula (II), (III) Amount added (mol/mol Ag) | Photographic Characteristics (1) Sensitivity | Photographic Characteristics (1) Dmax | Photographic Characteristics (1) Dmin | Photographic Characteristics (2) Sensitivity | Photographic Characteristics (2) Dmax | Photographic Characteristics (2) Dmin |
|---|---|---|---|---|---|---|---|---|---|---|
| 19 | " | " | " | $2 \times 10^{-3}$ | 117 | 4.9 | 0.07 | 112 | 5.0 | 0.07 |

As can be seen from the data in Table 3, the samples of the present invention had equivalent or better photographic characteristics compared with the comparative samples, and in particular, Sample Nos. 12 to 19, in which the compound of the general formula (I) and the compound of the general formula (II) or (III) were present in combination, showed low $D_{min}$, even when the samples were stored under high temperature and high humidity conditions had stable sensitivity, and did not cause the lowering of $D_{max}$.

EXAMPLE 6

A silver nitrate aqueous solution and a sodium bromide aqueous solution were added simultaneously at a constant rate to a gelatin aqueous solution kept at 70° C. over an 80-minute period while the potential of the reaction system was being regulated to +60 mV, whereby a cubic silver bromide monodispersed emulsion having a mean grain size of 0.2 μm was obtained.

The emulsion was subjected to a desalting treatment utilizing flocculation, and then thiourea dioxide and chloroauric acid were added thereto in amounts of 10 mg and 8 mg, respectively, per mol of silver. The resulting emulsion was ripened at 65° C. until it acquired the maximum ability. Thus, the emulsion was fogged.

The thus obtained emulsion was divided into fractions, and thereto were added the additives of the present invention as described in Table 4, respectively. Additionally, $6 \times 10^{-4}$ mol/mol silver of the compound (14) described in Japanese Patent Application (OPI) No. 29828/74 having the structural formula shown below was added, and then the pAg was adjusted properly by addition of $8 \times 10^{-14}$ mol/mol silver of polyalkylene oxide compound (IV-7) and a 10% KBr aqueous solution, thus preparing a coating composition. The coating composition was coated on a polyethylene terephthalate film at a silver coverage of 3.2 g/m² simultaneously with a protection layer comprising a silica matting agent. The thus obtained samples each were exposed to a tungsten lamp through an optical wedge, and evaluation was made according to the same criteria as in Example 5.

Compound (14) described in Japanese Patent Application (OPI) No. 29828/74

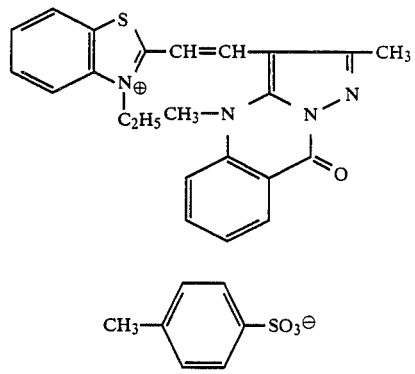

TABLE 4

| Sample No. | Compound of Formula (I) Kind | Compound of Formula (I) Amount added (mol/mol Ag) | Compound of Formula (II), (III) Kind | Compound of Formula (II), (III) Amount added (mol/mol Ag) | Photographic Characteristics (1) Sensitivity | Photographic Characteristics (1) Dmax | Photographic Characteristics (1) Dmin | Photographic Characteristics (2) Sensitivity | Photographic Characteristics (2) Dmax | Photographic Characteristics (2) Dmin | |
|---|---|---|---|---|---|---|---|---|---|---|---|
| 1 | — | — | — | — | 100 | 5.0 | 0.12 | 93 | 5.2 | 0.15 | |
| 2 | (I-2) | $1 \times 10^{-3}$ | — | — | 105 | 5.0 | 0.06 | 98 | 5.0 | 0.11 | |
| 3 | (I-3) | " | — | — | 112 | 5.0 | 0.06 | 107 | 4.9 | 0.09 | |
| 4 | (I-11) | " | — | — | 107 | 5.0 | 0.07 | 100 | 5.0 | 0.12 | |
| 5 | (I-23) | " | — | — | 110 | 5.0 | 0.06 | 100 | 5.0 | 0.10 | Invention |
| 6 | (I-39) | " | — | — | 107 | 4.9 | 0.06 | 100 | 4.9 | 0.10 | |
| 7 | (I-54) | " | — | — | 105 | 4.9 | 0.06 | 98 | 4.9 | 0.10 | |
| 8 | — | — | II-1 | $1 \times 10^{-3}$ | 102 | 5.0 | 0.12 | 95 | 5.0 | 0.13 | |
| 9 | — | — | II-4 | " | 115 | 5.0 | 0.10 | 100 | 5.0 | 0.10 | |
| 10 | (I-2) | $1 \times 10^{-3}$ | II-1 | " | 120 | 5.0 | 0.05 | 112 | 5.0 | 0.06 | |
| 11 | " | " | II-4 | " | 123 | 5.0 | 0.05 | 115 | 4.9 | 0.06 | |
| 12 | (I-3) | " | II-1 | " | 123 | 5.0 | 0.05 | 117 | 5.0 | 0.06 | |
| 13 | " | " | II-4 | " | 126 | 5.0 | 0.05 | 117 | 4.9 | 0.06 | |
| 14 | (I-11) | " | II-1 | " | 115 | 5.0 | 0.05 | 107 | 5.0 | 0.06 | |
| 15 | " | " | II-4 | " | 117 | 5.0 | 0.05 | 112 | 4.9 | 0.06 | |
| 16 | (I-23) | " | II-1 | " | 117 | 5.0 | 0.05 | 107 | 5.0 | 0.06 | Invention |
| 17 | " | " | II-4 | " | 123 | 5.0 | 0.05 | 115 | 5.0 | 0.06 | |
| 18 | (I-39) | " | II-1 | " | 112 | 4.9 | 0.05 | 102 | 4.8 | 0.06 | |
| 19 | " | " | II-4 | " | 120 | 4.8 | 0.05 | 107 | 4.6 | 0.06 | |
| 20 | (I-54) | " | II-1 | " | 110 | 5.0 | 0.06 | 102 | 4.8 | 0.07 | |
| 21 | " | " | II-4 | " | 115 | 4.9 | 0.05 | 107 | 4.7 | 0.07 | |

As can be seen from the data in Table 4, the samples of the present invention had equivalent or better photographic characteristics compared with the comparative samples, and in particular, Sample Nos. 10 to 21 in which the compound of the general formula (I) and the compound of the general formula (II) or (III) were present in combination, showed low $D_{min}$, even when the samples were stored under high temperature and high humidity conditions, had stable sensitivity, and did not cause the lowering of $D_{max}$.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic material comprising a support having thereon at least one silver halide emulsion layer comprising a prefogged direct-positive silver halide emulsion, said emulsion layer or a hydrophilic colloid layer adjacent to said emulsion layer containing at least one compound represented by the following general formula (I):

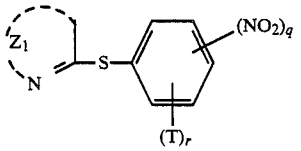

(I)

wherein $Z_1$ represents a group of nonmetallic atoms necessary to complete a nitrogen-containing hetero ring; T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group, or a benzocondensed ring, each of which is or is not further substituted; q represents 1, 2, or 3; and r represents 0, 1, or 2, and when said r is 2, two T's may be the same or different, wherein at least one compound represented by the following general formulae (II) or (III) is further contained in said silver halide emulsion layer or said hydrophilic colloid layer adjacent thereto:

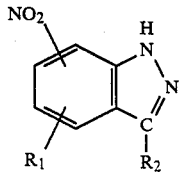

(II)

wherein $R_1$ represents a hydrogen atom, an alkyl group, a halogen atom —$SO_3M$, or —COOM (wherein M represents a hydrogen atom, an alkali metal ion or ammonium ion); and $R_2$ represents a hydrogen atom or a lower alkyl group:

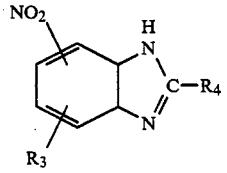

(III)

wherein $R_3$ represents a hydrogen atom, an alkyl group, a halogen atom, —$SO_3M$, or —COOM (wherein M represents a hydrogen atom, an alkali metal ion or an ammonium ion); and $R_4$ represents a hydrogen atom or an alkyl group.

2. The direct positive silver halide photographic material as claimed in claim 1, wherein the nitrogen-containing hetero ring completed by $Z_1$ is selected from a 1,2,4-triazole ring, a 1,3,4-oxadiazole ring, a 1,3,4-thiadiazole ring, a tetraazaindene ring, a pentaazaindene ring, a triazaindene ring, a benzothiazole ring, a benzoimidazole ring, a benzoxazole ring, a pyrimidine ring, a triazine ring, a pyridine ring, a quinoline ring, a quinazoline ring, a phthalazine ring, a quinoxaline ring, an imidazo quinoxaline ring, a tetrazole ring, or a 1,3-diazaazulene ring.

3. The direct positive silver halide photographic material as obtained in claim 1, wherein the compound of the general formula (I) is incorporated in an amount of $1\times10^{-6}$ to $5\times10^{-1}$ mol per mol of total silver halide.

4. The direct positive silver halide photographic material as claimed in claim 3, wherein the compound of the general formula (I) is incorporated in an amount of $1\times10^{-5}$ to $2\times10^{-2}$ mol per mol of total silver halide.

5. The direct positive silver halide photographic material as claimed in claim 1, wherein said silver halide emulsion comprises silver halides containing at least 70 mol % silver chloride.

6. The direct positive silver halide photographic material as claimed in claim 1, wherein said silver halide emulsion comprises silver chlorobromides containing at least 90 mol % silver chloride.

7. The direct positive silver halide photographic material as claimed in claim 1, wherein the compound of the general formulae (II) or (III) is incorporated in an amount of $1\times10^{-6}$ to $5\times10^{-1}$ mol per mol of total silver halide.

8. The direct positive silver halide photographic material as claimed in claim 1, wherein the compound of the general formulae (II) or (III) is incorporated in an amount of $1\times10^{-5}$ to $2\times10^{-2}$ mol per mol of total silver halide.

9. The direct positive silver halide photographic material as claimed in claim 1, wherein the silver halide emulsion layer further contains rhodium chloride in an amount of $1\times10^{-7}$ to $1\times10^{-2}$ mol per mol of silver halide.

10. The direct positive silver halide photographic material as claimed in claim 1, wherein the silver halide emulsion layer further contains rhodium chloride in an amount of $1\times10^{-5}$ to $1\times10^{-3}$ mol per mol of silver halide.

11. The direct positive silver halide photographic material as claimed in claim 1, wherein the compound of the general formulae (II) or (III) is contained in the silver halide emulsion layer.

12. The direct positive silver halide photographic material as claimed in claim 1, wherein the compound of the general formula (I) is contained in the silver halide emulsion layer.

13. The direct positive silver halide photographic material as claimed in claim 1, wherein the compound of the general formulae (II) or (III) is contained in the same layer with the compound of the general formula (I).

14. The direct positive silver halide photographic material as claimed in claim 1, wherein the compound of the general formula (I) is incorporated in an amount of $1\times10^{-6}$ to $5\times10^{-1}$ mol per mol of total silver halide, the compound of general formulae (II) or (III) is incorporated in an amount of $1\times10^{-6}$ to $5\times10^{-1}$ mol per mol of total silver halide and wherein the compounds of general formula (I), (II) or (III) are contained in the silver halide emulsion layer.

15. The direct positive silver halide photographic material as claimed in claim 14, wherein said silver halide comprises silver chlorobromides containing at least 90 mol % silver chloride and wherein the silver halide emulsion layer further contains rhodium chloride in an amount of $1\times10^{-7}$ to $1\times10^{-2}$ mol per mol of silver halide.

* * * * *